US010892118B2

(12) United States Patent
Yang et al.

(10) Patent No.: US 10,892,118 B2
(45) Date of Patent: Jan. 12, 2021

(54) BUTTON MODULE

(71) Applicant: Wistron Corporation, New Taipei (TW)

(72) Inventors: Qi-Hong Yang, New Taipei (TW); Yu-Wei Liu, New Taipei (TW); Cheng-Hsiu Lee, New Taipei (TW); Tzu-Fa Yen, New Taipei (TW); Guang-Zong Li, New Taipei (TW)

(73) Assignee: Wistron Corporation, New Taipei (TW)

( * ) Notice: Subject to any disclaimer, the term of this patent is extended or adjusted under 35 U.S.C. 154(b) by 16 days.

(21) Appl. No.: 16/258,699

(22) Filed: Jan. 28, 2019

(65) Prior Publication Data

US 2020/0144004 A1 May 7, 2020

(30) Foreign Application Priority Data

Nov. 5, 2018 (TW) ..... 107139147 A

(51) Int. Cl.

| | |
|---|---|
| ***H01H 13/14*** | (2006.01) |
| ***H01H 13/20*** | (2006.01) |
| ***H01H 13/10*** | (2006.01) |
| ***H01H 13/04*** | (2006.01) |

(52) U.S. Cl.

CPC ..... *H01H 13/14* (2013.01); *H01H 13/04* (2013.01); *H01H 13/10* (2013.01); *H01H 13/20* (2013.01)

(58) Field of Classification Search

CPC ..... H01H 13/14; H01H 13/705; H01H 2227/036; H01H 13/20; H01H 13/10; H01H 13/04; H01H 2025/048; H01H 2235/006; H01H 2235/028

See application file for complete search history.

(56) References Cited

U.S. PATENT DOCUMENTS 6,335,500 B1 * 1/2002 Chi ..... H01H 13/60 200/314
2005/0224330 A1 * 10/2005 Liu ..... H01H 13/48 200/345

FOREIGN PATENT DOCUMENTS

TW 454215 9/2001
TW I233626 6/2005

* cited by examiner

*Primary Examiner* — Ahmed M Saeed
(74) *Attorney, Agent, or Firm* — Winston Hsu

(57) ABSTRACT

A button module includes a casing, a button body, an elastic body and a cover. The casing includes a first accommodating recess, a first engaging portion and a retaining platform. The button body is disposed in the first accommodating recess. The button body includes a first positioning portion. The elastic body is disposed between the button body and the retaining platform. The cover is disposed on the casing. The cover includes a second engaging portion, a second positioning portion and a retaining portion. The second engaging portion engages with the first engaging portion. The second positioning portion cooperates with the first positioning portion to position the button body in the first accommodating recess. The retaining portion abuts against the retaining platform.

9 Claims, 13 Drawing Sheets

BUTTON MODULE

BACKGROUND OF THE DISCLOSURE

1. Field of the Disclosure

The disclosure relates to a button module and, more particularly, to a button module capable of being pressed easily and being assembled or disassembled conveniently.

2. Description of the Prior Art

At present, lots of electronic devices are equipped with a button for purpose of operation, so as to perform related function. The prior art usually fixes the button on a casing of the electronic device by a hot melt process. Consequently, a user cannot assemble or disassemble the button himself/herself, such that it is not beneficial to maintain or replace the button. Furthermore, when the button is pressed, the button rotates around a fixing end. When the user presses an edge of the button, the button may not rotate smoothly due to a seesaw effect.

SUMMARY OF THE DISCLOSURE

The disclosure provides a button module capable of being pressed easily and being assembled or disassembled conveniently, so as to solve the aforesaid problems.

According to an embodiment of the disclosure, a button module includes a casing, a button body, an elastic body and a cover. The casing includes a first accommodating recess, a first engaging portion and a retaining platform. The button body is disposed in the first accommodating recess. The button body includes a first positioning portion. The elastic body is disposed between the button body and the retaining platform. The cover is disposed on the casing. The cover includes a second engaging portion, a second positioning portion and a retaining portion. The second engaging portion engages with the first engaging portion. The second positioning portion cooperates with the first positioning portion to position the button body in the first accommodating recess. The retaining portion abuts against the retaining platform.

As mentioned in the above, the disclosure disposes the button body in the first accommodating recess of the casing by the structural cooperation between the casing, the button body and the cover. A user only needs to detach the cover from the casing and then he/she can take the button body out of the first accommodating recess of the casing. Accordingly, the user can assemble or disassemble the button module rapidly and conveniently without using a tool. Furthermore, by means of the cooperation between the first positioning portion of the button body and the second positioning portion of the cover, the button body can move smoothly with respect to the casing without a seesaw effect no matter which position of the button body is pressed by the user.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
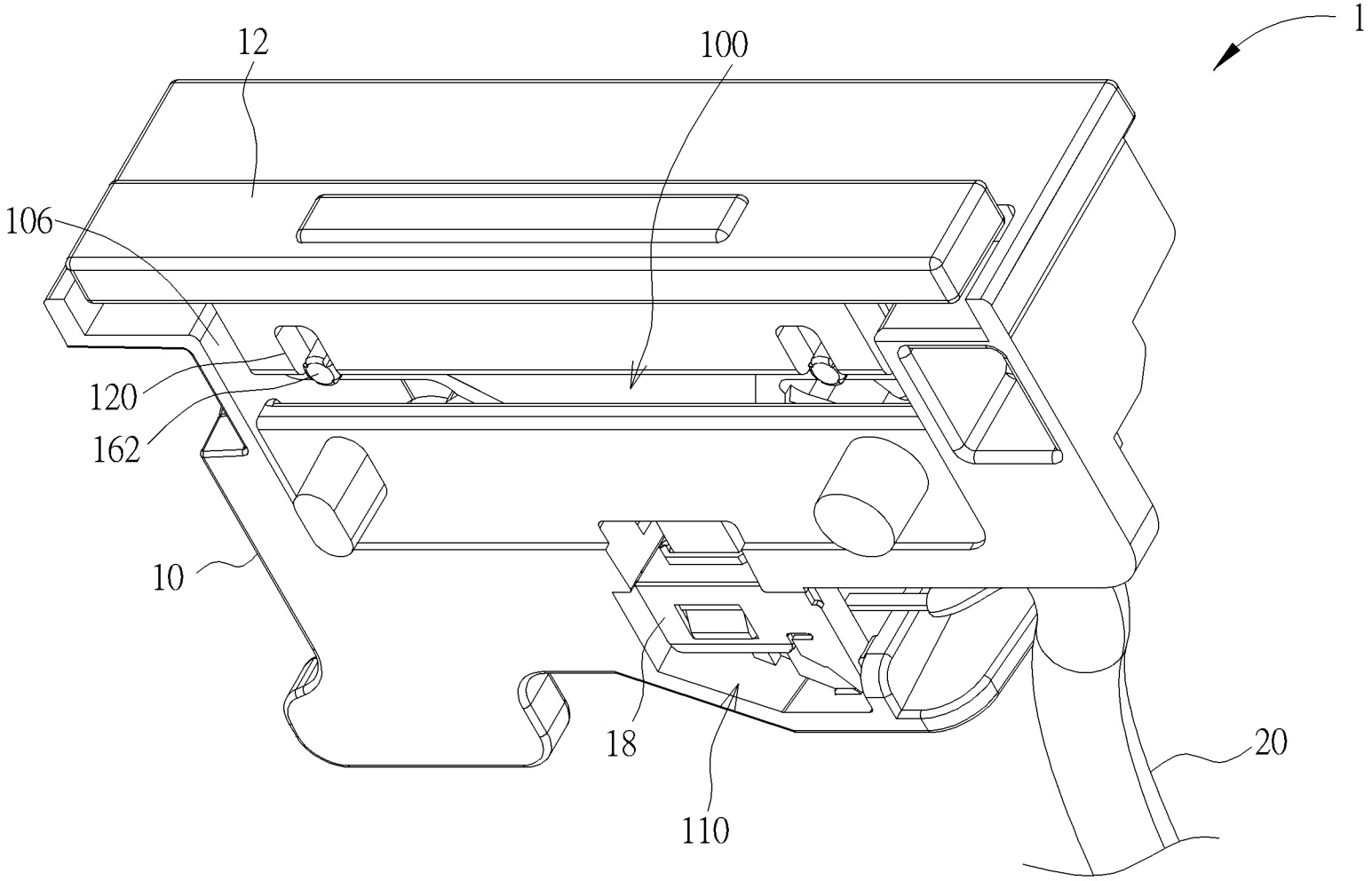
FIG. 1 is a perspective view illustrating a button module according to an embodiment of the disclosure.

Referring to FIGS. 1 to 5, a button module 1 includes a casing 10, a button body 12, an elastic body 14 and a cover 16. The button module 1 may be disposed in any devices according to practical applications. The casing 10 includes a first accommodating recess 100, a first engaging portion 102 and a retaining platform 104. In this embodiment, the casing 10 may include two first engaging portions 102, wherein the two first engaging portions 102 are located at opposite sides of the first accommodating recess 100.

The button body 12 is disposed in the first accommodating recess 100 of the casing 10. The button body 12 includes a first positioning portion 120. In this embodiment, the button body 12 may include two first positioning portions 120, wherein the two first positioning portions 120 are located at opposite sides of the button body 12. The first positioning portion 120 may be, but not limited to, a slot.

The elastic body 14 is disposed between the button body 12 and the retaining platform 104 of the casing 10. In this embodiment, two elastic bodies 14 are formed on opposite sides of the button body 12 integrally. The elastic body 14 may include a plurality of straight portions 140 and at least one curved portion 142, wherein the curved portion 142 is located between the straight portions 140. In this embodiment, the elastic body 14 may include three straight portions 140 and two curved portions 142, but is not so limited. Furthermore, the elastic body 14 may extend from the button body 12 to form a U-shape.

The cover 16 is disposed on the casing 10. The cover 16 includes a second engaging portion 160, a second positioning portion 162 and a retaining portion 164. In this embodiment, the second engaging portion 160 of the cover 16 corresponds to the first engaging portion 102 of the casing 10 and the second positioning portion 162 of the cover 16 corresponds to the first positioning portion 120 of the button body 12. Accordingly, the cover 16 may include two second engaging portions 160 and two second positioning portions 162, wherein the two second engaging portions 160 are located at opposite sides of the cover 16 and the two second positioning portions 162 are also located at opposite sides of the cover 16. The second positioning portion 162 may be, but not limited to, a protrusion and the protrusion may have, but not limited to, a circular shape. Still further, the cover 16 may include two retaining portions 164 located at opposite sides of the cover 16.

Figure 5:
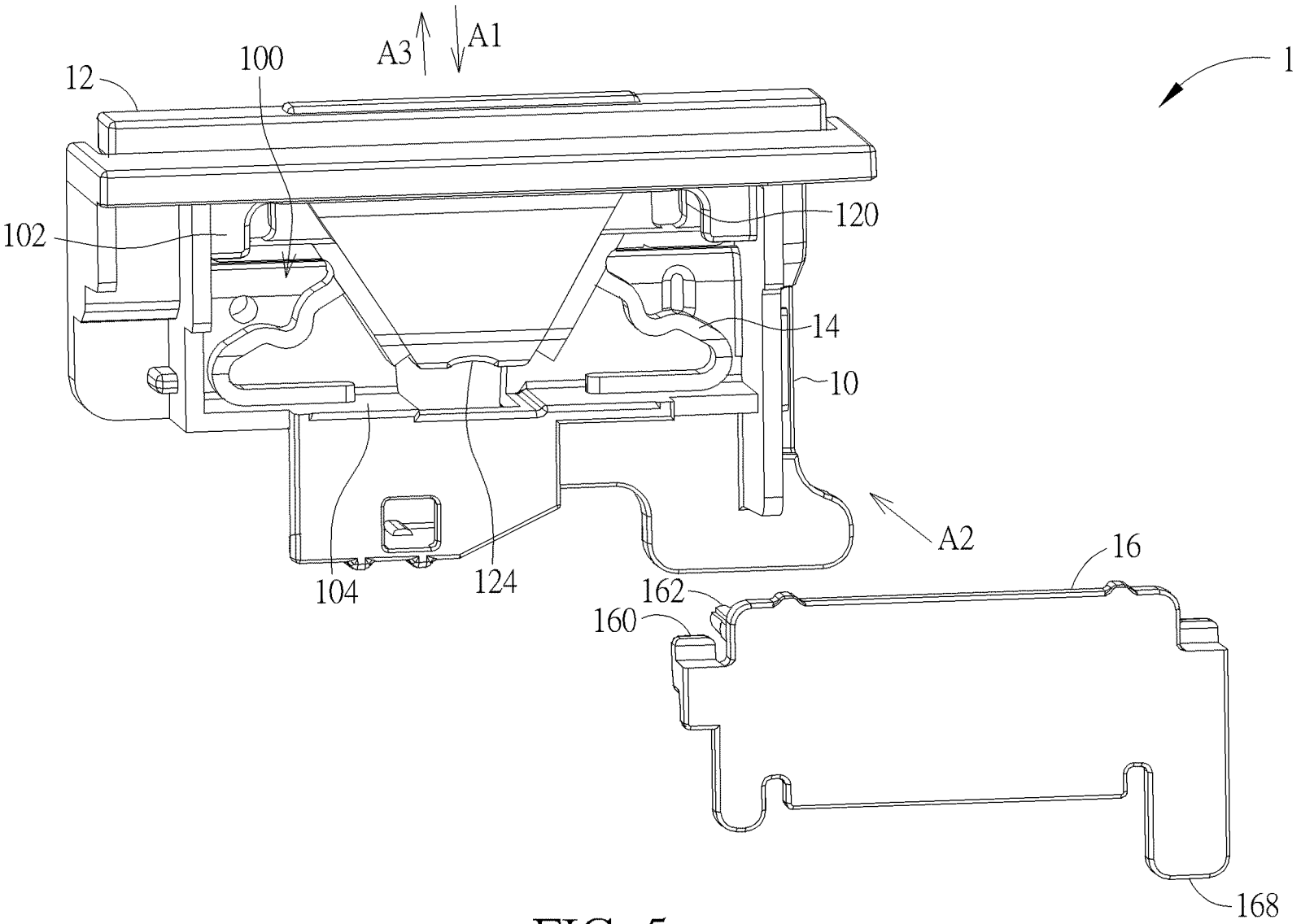
FIG. 5 is a perspective view illustrating the button body disposed in the first accommodating recess of the casing.
Figure 7:
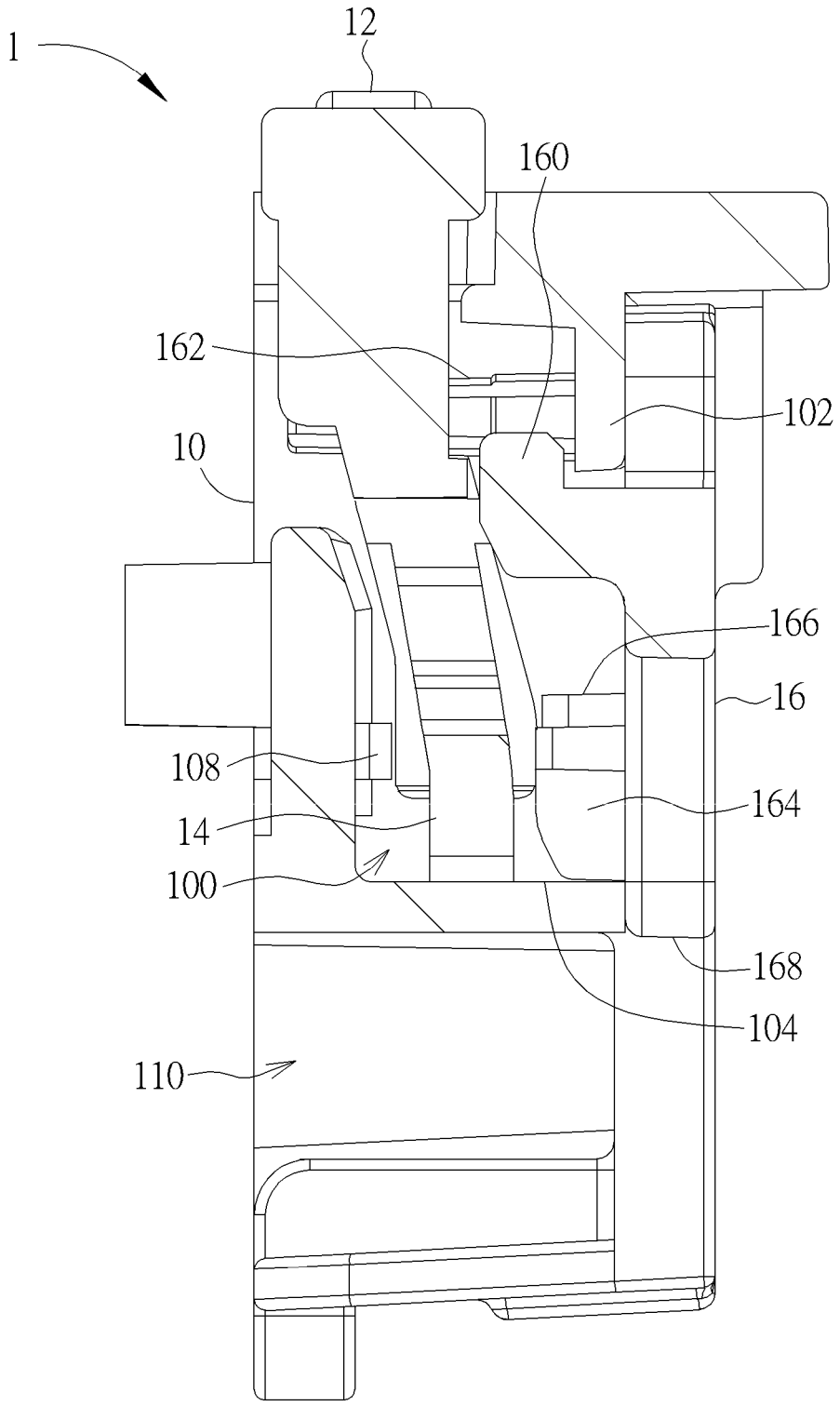
FIG. 7 is a sectional view illustrating the button module shown in FIG. 6 along line X-X.

To assemble the button module 1, a user may dispose the button body 12 in the first accommodating recess 100 of the casing 10 first. At this time, the elastic body 14 abuts against the retaining platform 104 of the casing 10, as shown in FIG. 5. Then, the user may press the button body 12 along a direction of an arrow A1 to deform the elastic body 14 elastically and then the user may insert the second positioning portion 162 of the cover 16 into the first positioning portion 120 of the button body 12 along a direction of an arrow A2, such that the second engaging portion 160 of the cover 16 engages with the first engaging portion 102 of the casing 10 and the retaining portion 164 of the cover 16 abuts against the retaining platform 104 of the casing 10, as shown in FIG. 7. Accordingly, the cover 16 is disposed on the casing 10 stably. Then, the user may release the button body 12, such that an elastic force provided by the elastic body 14 drives the button body 12 to return to an initial position along a direction of an arrow A3. At this time, the second positioning portion 162 of the cover 16 cooperates with the first positioning portion 120 of the button body 12 to position the button body 12 in the first accommodating recess 100 of the casing 10. For further illustration, the second positioning portion 162 of the cover 16 cooperates with the first positioning portion 120 of the button body 12 to restrain a moving distance and a moving direction of the button body 12 and prevent the button body 12 from coming off the casing 10.

When the user presses the button body 12 by a force, the force is dispersed and delivered uniformly along the straight portions 140 and the curved portions 142 of the elastic body 14, such that the button body 12 moves smoothly with respect to the casing 10. In this embodiment, a deformation direction of the elastic body 14 is identical to a direction of the force. Accordingly, the button body 12 can move smoothly with respect to the casing 10 without a seesaw effect no matter which position of the button body 12 is pressed by the user.

Figure 6:
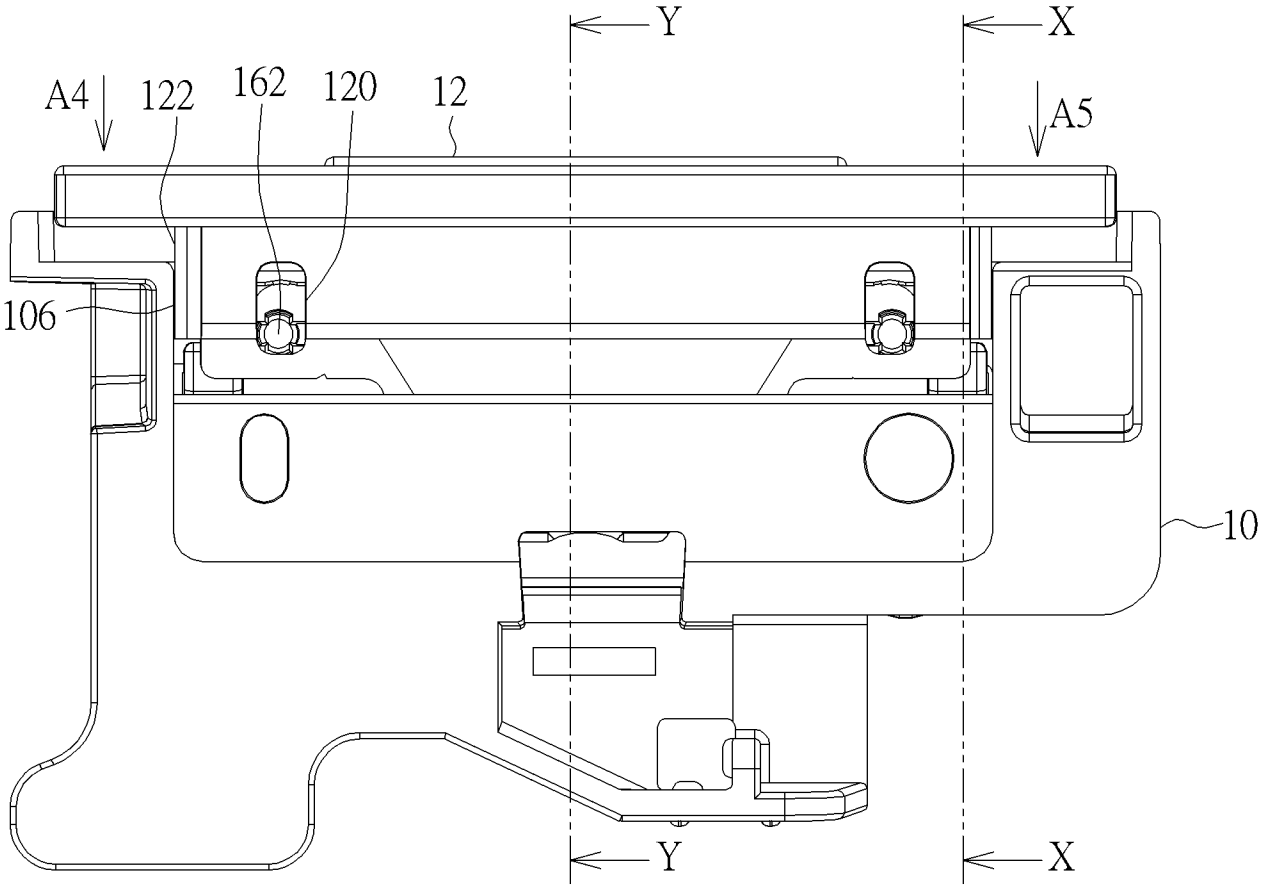
FIG. 6 is a front view illustrating the button module shown in FIG. 1.

In this embodiment, the button body 12 may further include two first restraining portions 122, wherein the two first restraining portions 122 are located at opposite sides of the button body 12. After assembling the button module 1, the first restraining portion 122 of the button body 12 faces a side wall 106 of the first accommodating recess 100 of the casing 10. As shown in FIG. 6, when the user presses the button body 12 at a specific position indicated by an arrow A4 or A5, the first restraining portion 122 is restrained by the side wall 106, so as to prevent the button body 12 from rotating and then raising. Accordingly, the button body 12 can move smoothly with respect to the casing 10.

Figure 2:
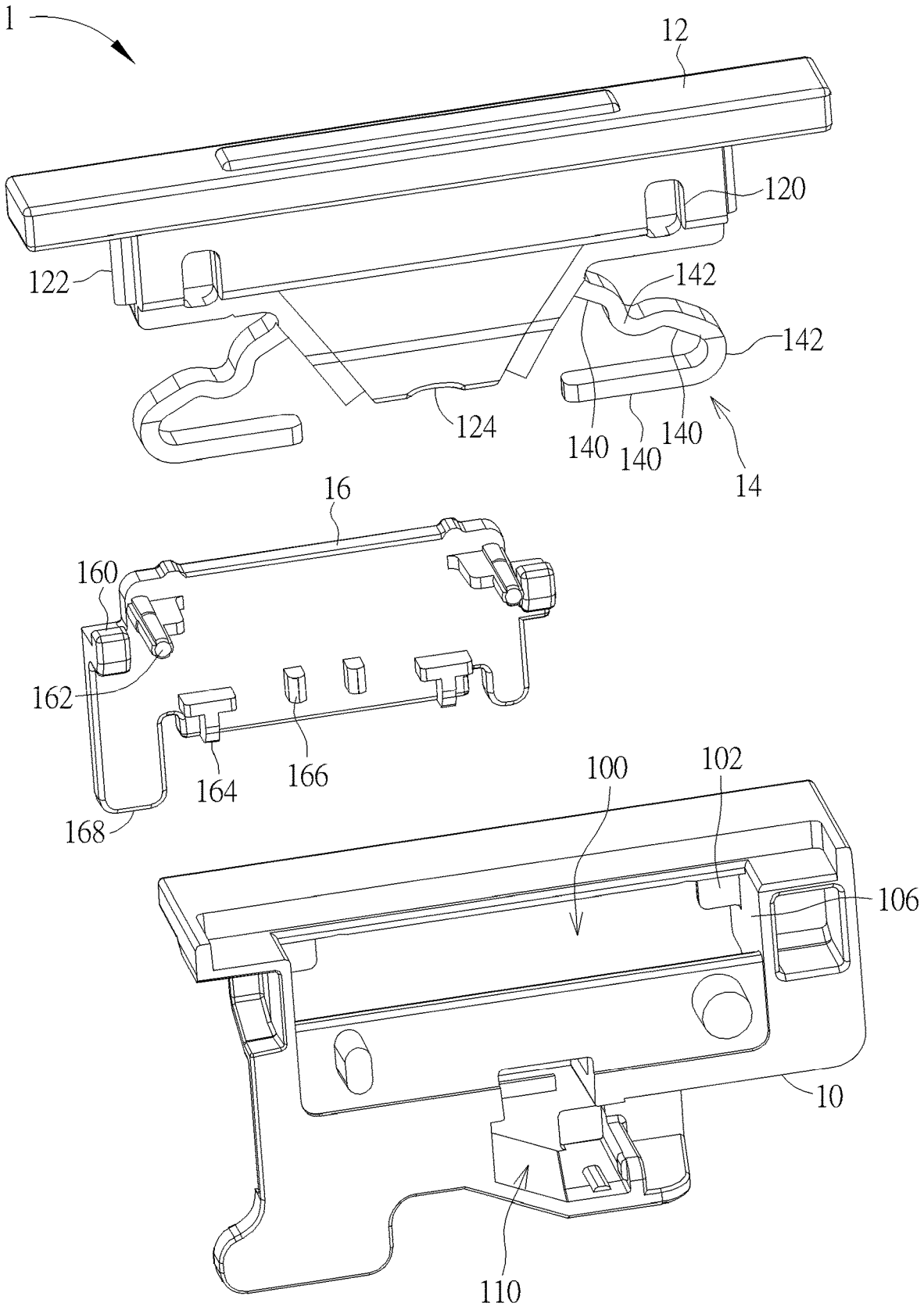
FIG. 2 is an exploded view illustrating the button module shown in FIG. 1.
Figure 4:
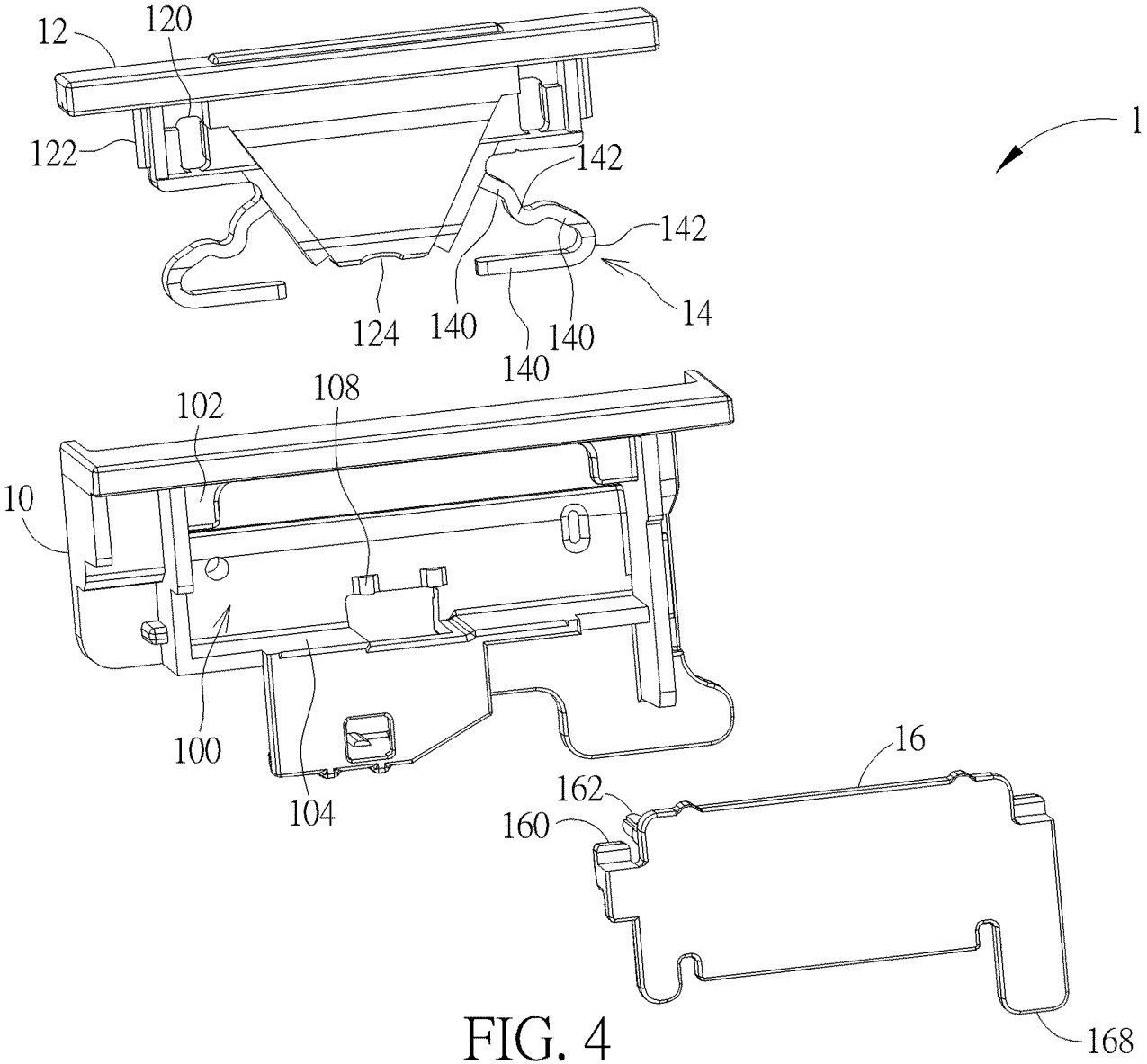
FIG. 4 is an exploded view illustrating the button module shown in FIG. 3.
Figure 8:
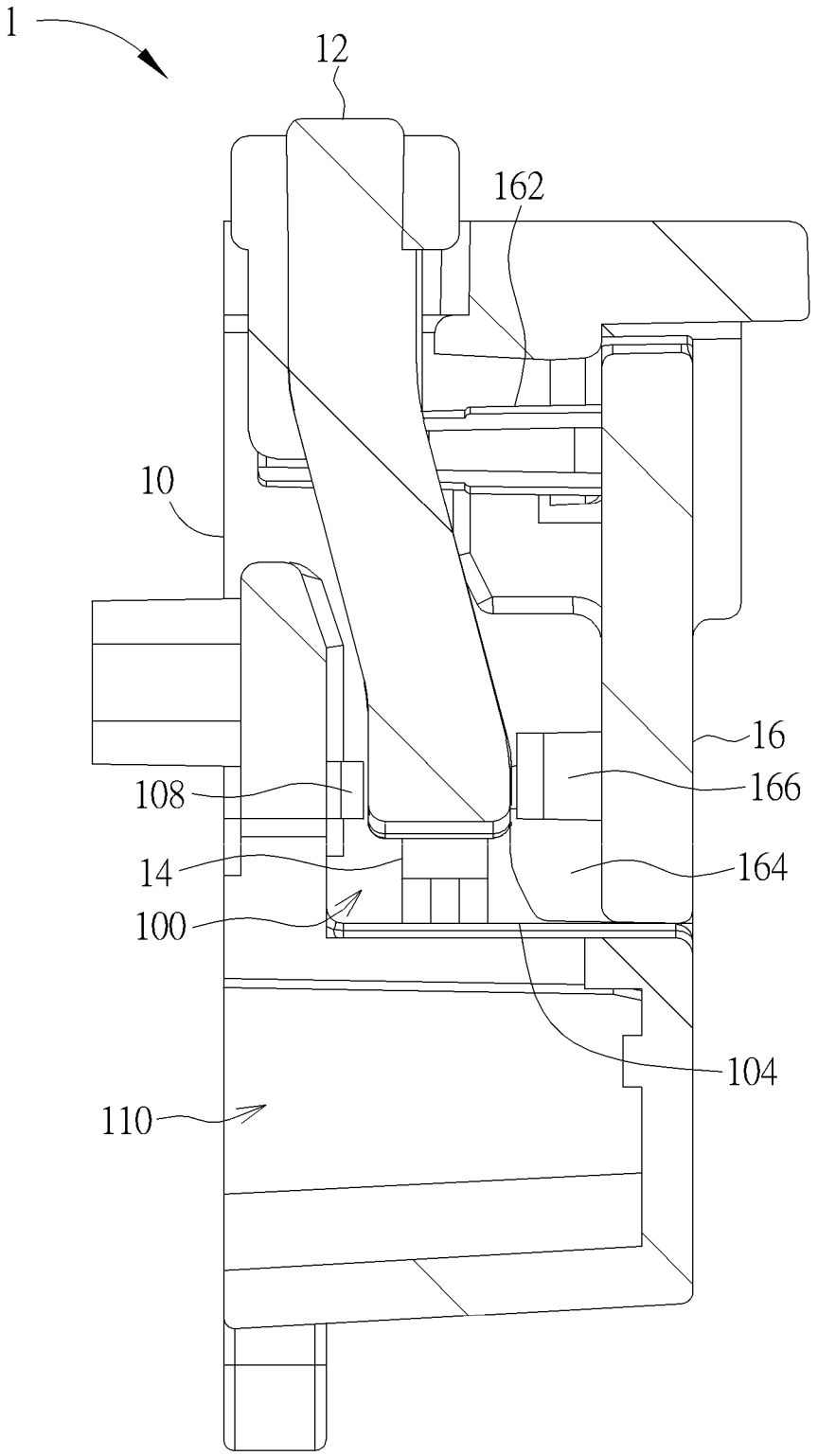
FIG. 8 is a sectional view illustrating the button module shown in FIG. 6 along line Y-Y.

In this embodiment, the button body 12 may incline to the cover 16, as shown in FIG. 8. The cover 16 may further include a second restraining portion 166. After assembling the button module 1, the second restraining portion 166 of the cover 16 abuts against the button body 12 (as shown in FIG. 8), so as to restrain the moving direction of the button body 12. Furthermore, the casing 10 may further include a third restraining portion 108. After assembling the button module 1, the button body 12 is sandwiched in between the second restraining portion 166 of the cover 16 and the third restraining portion 108 of the casing 10 (as shown in FIG. 8), so as to restrain the moving direction of the button body 12. In this embodiment, the cover 16 may include two second restraining portions 166 and the casing 10 may include two third restraining portions 108, as shown in FIGS. 2 and 4.

Figure 3:
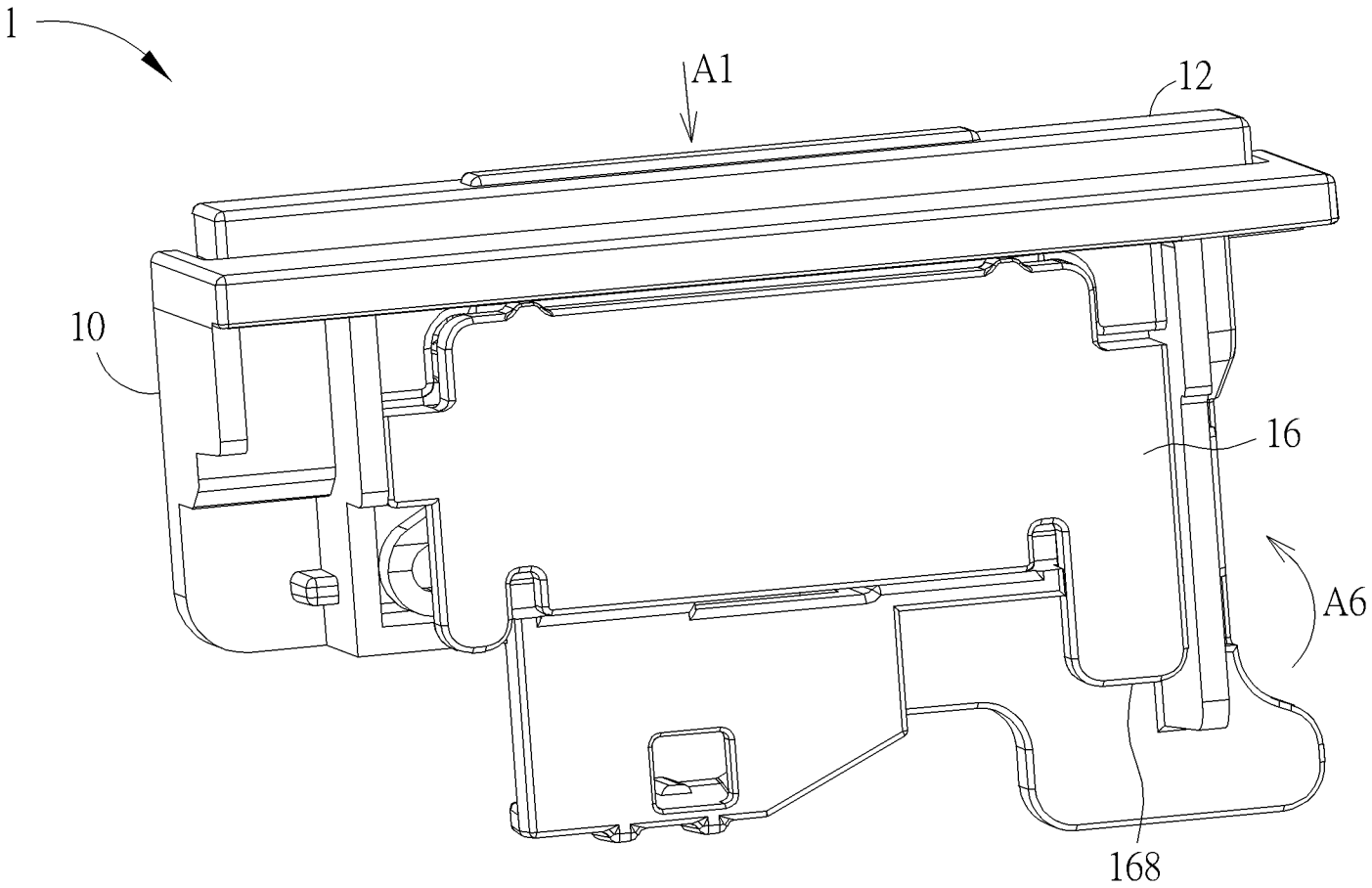
FIG. 3 is a perspective view illustrating the button module shown in FIG. 1 from another viewing angle.

In this embodiment, the cover 16 may further include a handle 168. As shown in FIG. 3, the user may press the button body 12 along the direction of the arrow A1 and then pull the handle 168 in a direction away from the casing 10 (i.e. the direction of an arrow A6), so as to detach the cover 16 from the casing 10. When the handle 168 is pulled along the direction away from the casing 10, the second engaging portion 160 of the cover 16 disengages from the first engaging portion 102 of the casing 10. After detaching the cover 16 from the casing 10, the user can take the button body 12 out of the first accommodating recess 100 of the casing 10 accordingly.

In this embodiment, the button module 1 may further include a switch 18 and the casing 10 may further include a second accommodating recess 110, wherein the second accommodating recess 110 is connected to the first accommodating recess 100. As shown in FIG. 1, the switch 18 may be disposed in the second accommodating recess 110 and the switch 18 may be electrically connected to a circuit board (not shown) by a cable 20. Furthermore, the button body 12 may further include a trigger portion 124. When the button body 12 is pressed, the trigger portion 124 triggers the switch 18 to perform related function.

Figure 9:
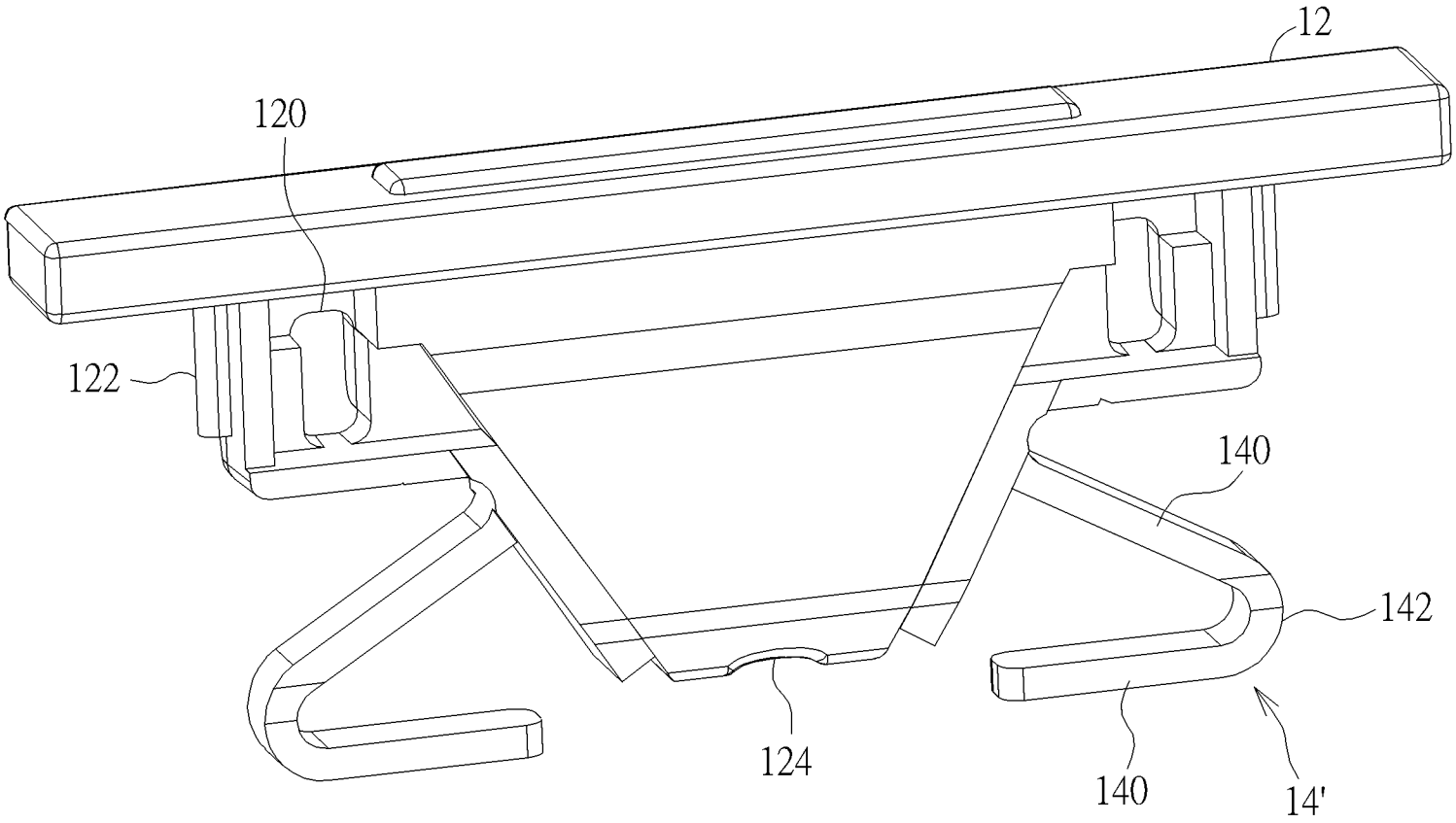
FIG. 9 is a perspective view illustrating a button body and an elastic body according to another embodiment of the disclosure.

Referring to FIG. 9, the main difference between an elastic body 14' shown in FIG. 9 and the aforesaid elastic body 14 is that the elastic body 14' includes two straight portions 140 and one curved portion 142. Accordingly, the number of the straight portions and the curved portions of the elastic body may be determined according to practical applications.

Figure 10:
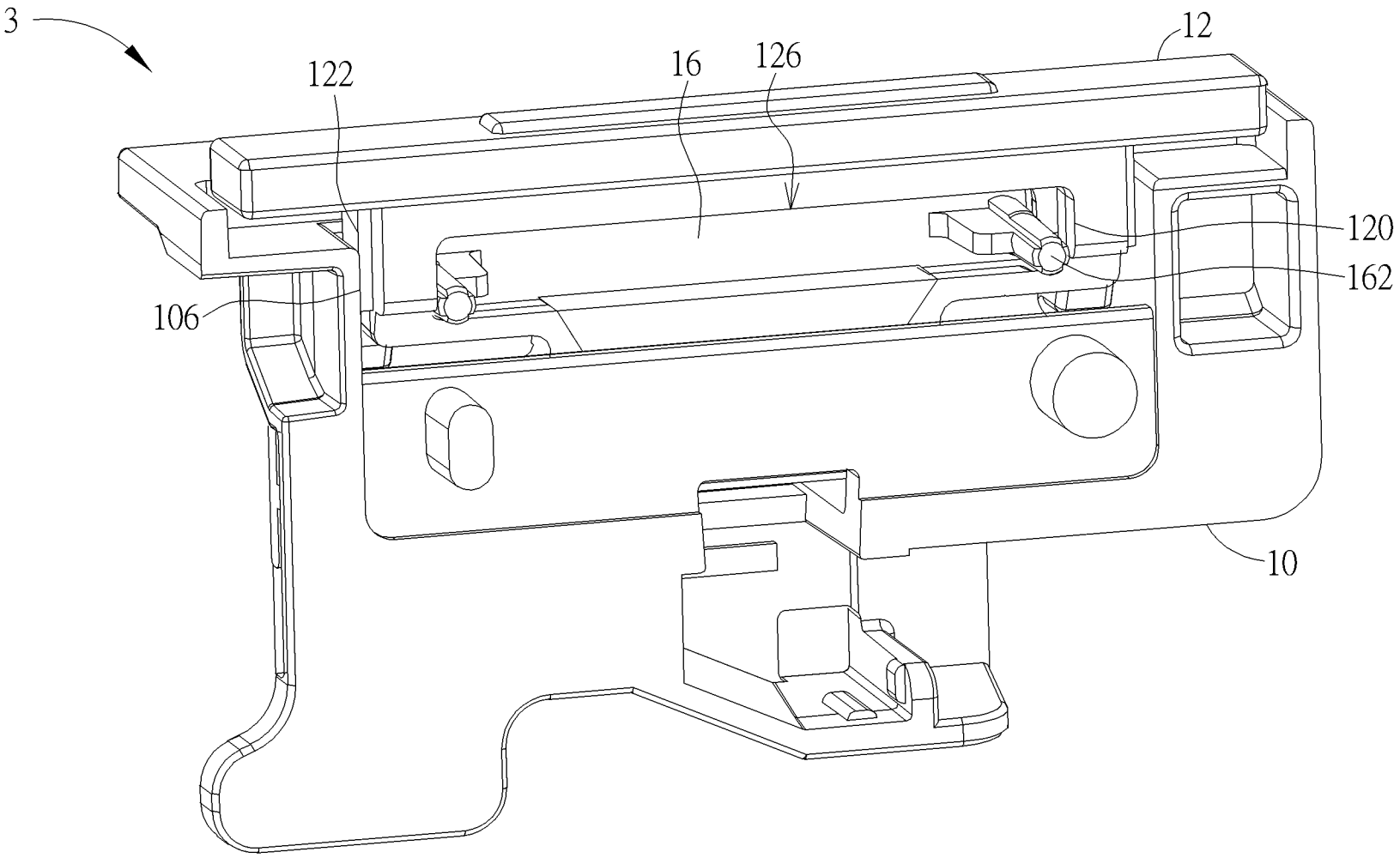
FIG. 10 is a perspective view illustrating a button module according to another embodiment of the disclosure.

Referring to FIG. 10, the main difference between a button module 3 shown in FIG. 10 and the aforesaid button module 1 is that the first positioning portion 120 of the button body 12 of the button module 3 is a side wall of a longitudinal hole 126. In other words, the first positioning portion 120 of the button body 12 is not limited to the slot of the aforesaid embodiment.

Figure 11:
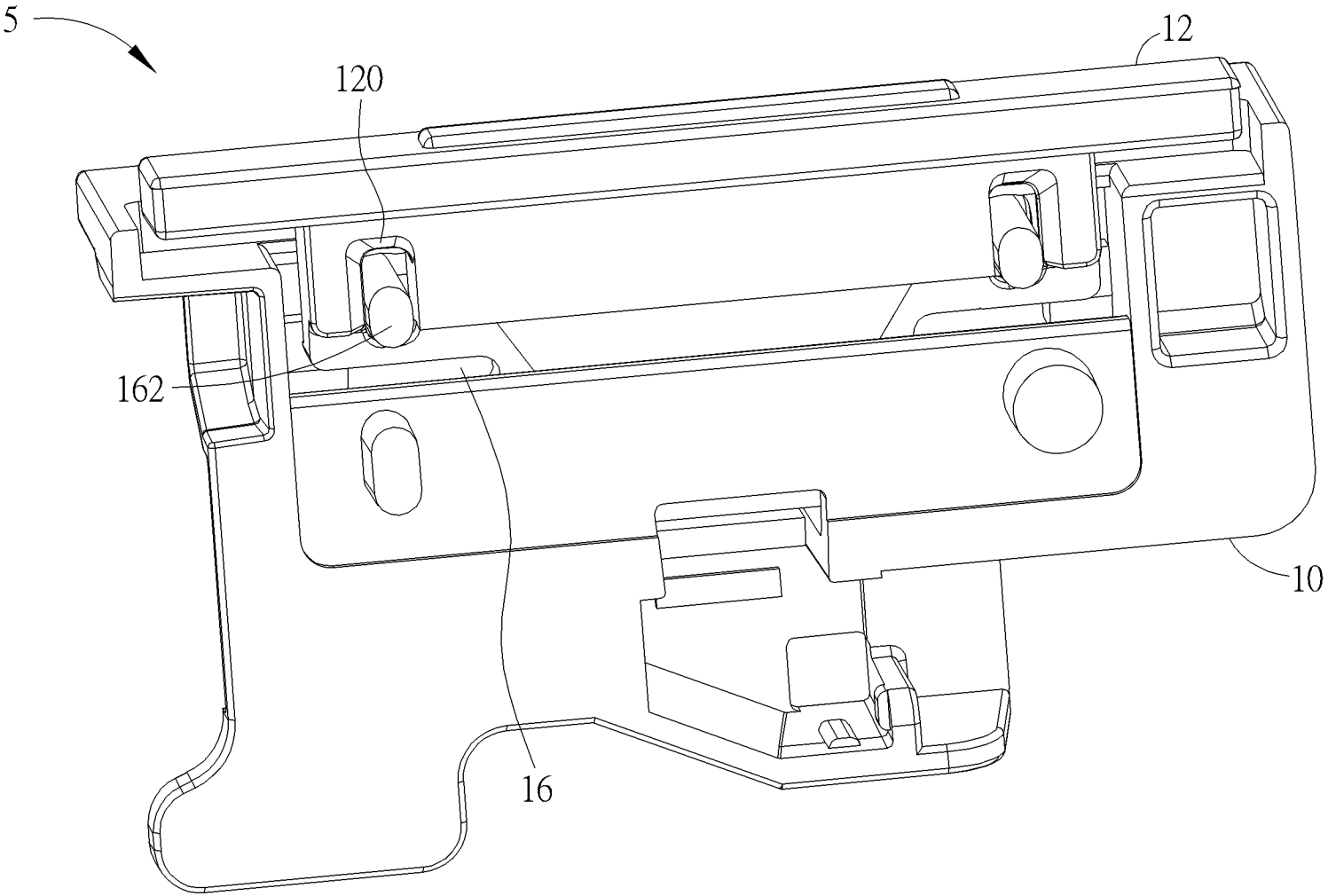
FIG. 11 is a perspective view illustrating a button module according to another embodiment of the disclosure.

Referring to FIG. 11, the main difference between a button module 5 shown in FIG. 11 and the aforesaid button module 1 is that the second positioning portion 162 of the cover 16 of the button module 5 is a protrusion having an oval-like shape, so as to increase a contact area between the second positioning portion 162 of the cover 16 and the first positioning portion 120 of the button body 12. When the user presses the button body 12, the first positioning portion 120 is restrained by the second positioning portion 162, so as to prevent the button body 12 from rotating and then raising. Accordingly, in this embodiment, the aforesaid first restraining portion 122 may be omitted from the button body 12.

Figure 12:
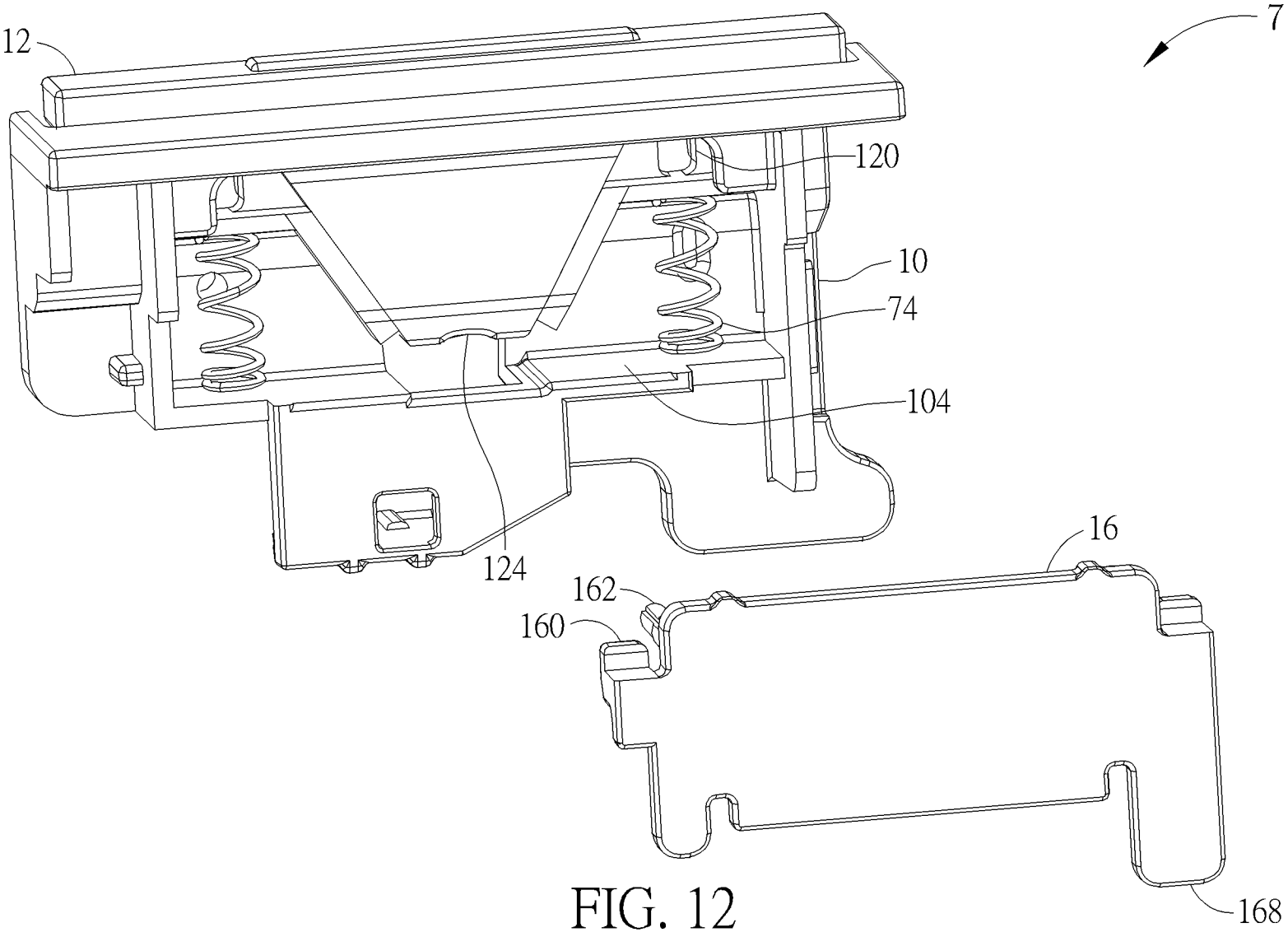
FIG. 12 is a perspective view illustrating a button module according to another embodiment of the disclosure.

Referring to FIG. 12, the main difference between a button module 7 shown in FIG. 12 and the aforesaid button module 1 is that an elastic body 74 of the button module 7 is a spring disposed between the button body 12 and the retaining platform 104 of the casing 10. When the button body 12 is pressed, the elastic body 74 is compressed. When the button body 12 is released, an elastic force provided by the elastic body 74 drives the button body 12 to return to the initial position.

Figure 13:
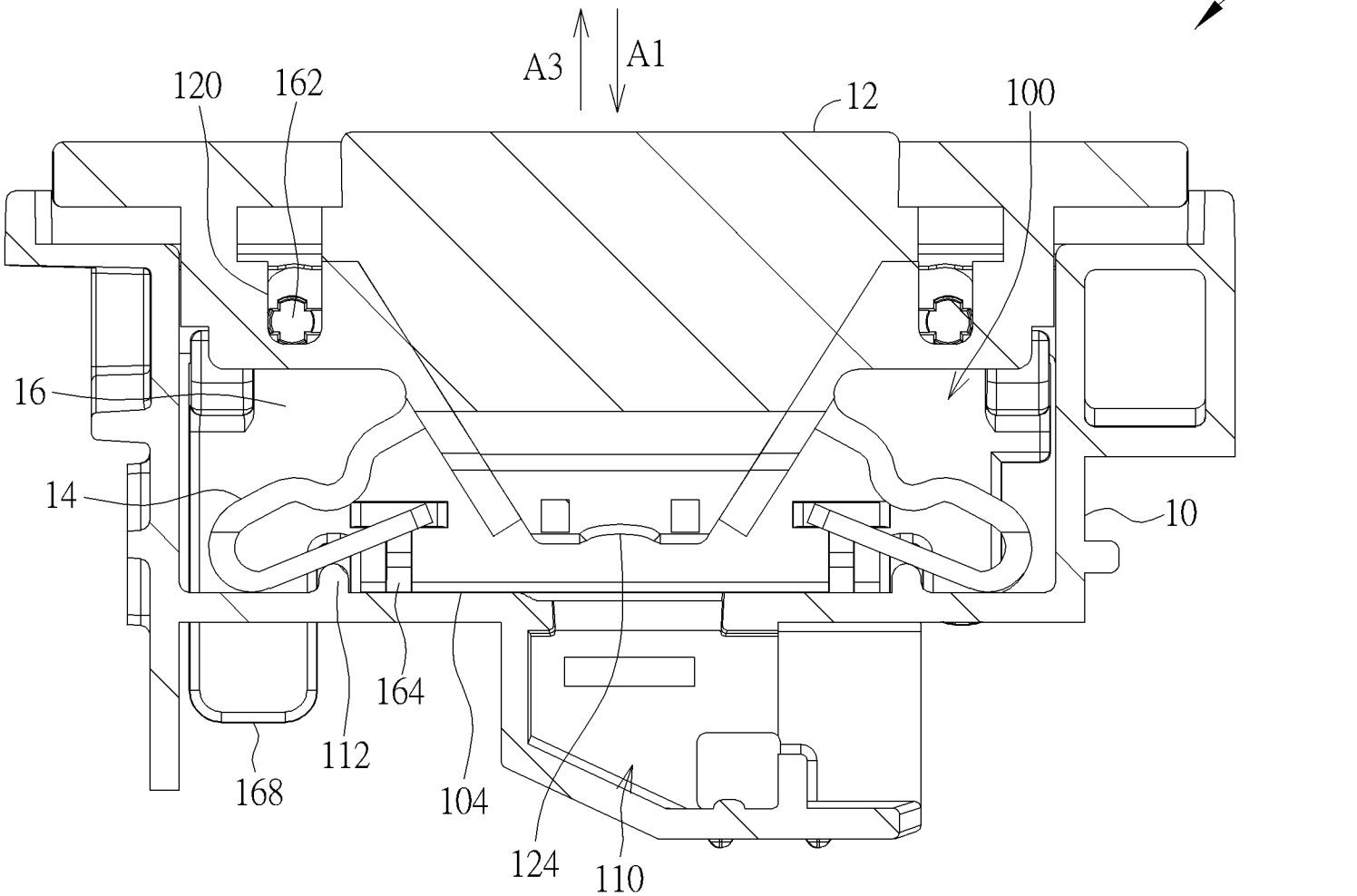
FIG. 13 is a sectional view illustrating a button module according to another embodiment of the disclosure.

Referring to FIG. 13, the main difference between a button module 9 shown in FIG. 13 and the aforesaid button module 1 is that the retaining platform 104 of the casing 10 of the button module 9 includes a protruding portion 112. In this embodiment, the protruding portion 112 corresponds to the elastic body 14. Accordingly, the retaining platform 104 may include two protruding portions 112. As shown in FIG. 13, when the button body 12 is disposed in the first accommodating recess 100 of the casing 10, the elastic body 14 is pushed by the protruding portion 112 to deform elastically, such that the elastic body 14 provides an elastic force along the direction of the arrow A3. At this time, the second positioning portion 162 of the cover 16 abuts against a lower edge of the first positioning portion 120 of the button body 12, so as to restrain the button body 12 from moving along the direction of the arrow A3. Accordingly, the button body 12 may not come off the casing 10 due to the elastic force of the elastic body 14. By means of the elastic force of the elastic body 14, the button body 12 can be positioned in the first accommodating recess 100 of the casing 10 more stably, such that the button body 12 may not shift or shake due to manufacture tolerance and/or assembly tolerance. When the user presses the button body 12 along the direction of the arrow A1, the elastic body 14 is pushed by the protruding portion 112 to further deform elastically in the direction of the arrow A1, such that the button body 12 moves along the direction of the arrow A1. When the user releases the button body 12, the elastic force provided by the elastic body 14 drives the button body 12 to return to the initial position along the direction of the arrow A3.

As mentioned in the above, the disclosure disposes the button body in the first accommodating recess of the casing by the structural cooperation between the casing, the button body and the cover. A user only needs to detach the cover from the casing and then he/she can take the button body out of the first accommodating recess of the casing. Accordingly, the user can assemble or disassemble the button module rapidly and conveniently without using a tool. Furthermore, by means of the cooperation between the first positioning portion of the button body and the second positioning portion of the cover, the button body can move smoothly with respect to the casing without a seesaw effect no matter which position of the button body is pressed by the user.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A button module comprising: a casing comprising a first accommodating recess, a first engaging portion and a retaining platform, the retaining platform being located within the first accommodating recess; a button body disposed in the first accommodating recess, the button body comprising a first positioning portion; an elastic body disposed between the button body and the retaining platform, the elastic body abutting against the retaining platform; and a cover comprising a second engaging portion, a second positioning portion and a retaining portion, the second engaging portion engaging with the first engaging portion, the second positioning portion protruding from a surface of the cover and being disposed in the first positioning portion so that the button body is positioned in the first accommodating recess, the retaining portion abutting against the retaining platform within the first accommodating recess; wherein the button body inclines to the cover, the cover further comprises a second restraining portion, and the second restraining portion abuts against the button body; wherein the casing further comprises a third restraining portion, and the button body is sandwiched in between the second restraining portion and the third restraining portion.

2. The button module of claim 1, wherein the elastic body comprises a plurality of straight portions and at least one curved portion, and the at least one curved portion is located between the straight portions.

3. The button module of claim 1, wherein the elastic body is a spring.

4. The button module of claim 1, wherein the first positioning portion is a slot and the second positioning portion is a protrusion.

5. The button module of claim 4, wherein the protrusion has a circular shape or an oval-like shape.

6. The button module of claim 1, wherein the button body further comprises a first restraining portion, and the first restraining portion faces a side wall of the first accommodating recess.

7. The button module of claim 1, wherein the cover further comprises a handle and the second engaging portion disengages from the first engaging portion when the handle is pulled along a direction away from the casing.

8. The button module of claim 1, wherein the button module further comprises a switch, the casing further comprises a second accommodating recess, the switch is disposed in the second accommodating recess, the second accommodating recess is connected to the first accommodating recess, the button body further comprises a trigger portion, and the trigger portion triggers the switch when the button body is pressed.

9. The button module of claim 1, wherein the retaining platform comprises a protruding portion and the elastic body is pushed by the protruding portion to deform elastically when the button body is disposed in the first accommodating recess.

* * * * *